US006277306B1

(12) United States Patent
Endo et al.

(10) Patent No.: US 6,277,306 B1
(45) **Date of Patent: *Aug. 21, 2001**

(54) ELECTRO-RHEOLOGICAL FLUID HAVING HIGH DIELECTRIC BREAKDOWN STENGTH AND METHODS OF MAKING AND STORING THE ELECTRO-RHEOLOGICAL FLUID

(75) Inventors: Shigeki Endo, Tokorozawa; Takayuki Maruyama, Kodaira; Hiroaki Wada, Kawasaki; Tasuku Saito, Tokorozawa, all of (JP)

(73) Assignee: Bridgestone Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,457

(22) Filed: Nov. 27, 1998

(30) Foreign Application Priority Data

Dec. 15, 1997 (JP) ..... 9-345517

(51) Int. Cl.[7] ..... H01B 3/20
(52) U.S. Cl. ..... 252/572; 252/70; 252/73
(58) Field of Search ..... 252/572, 73

(56) References Cited

U.S. PATENT DOCUMENTS 5,294,360 * 3/1994 Carlson et al. ..... 525/74
5,445,760 * 8/1995 Pollack ..... 252/73
5,536,426 * 7/1996 Sasaki et al. ..... 252/73
5,910,269 * 6/1999 Ono et al. ..... 252/73

FOREIGN PATENT DOCUMENTS 5-112793 * 5/1993 (JP) .
11-172269 * 6/1999 (JP) .
94/09097 * 4/1994 (WO) .

* cited by examiner

*Primary Examiner*—Mark Kopec
*Assistant Examiner*—D G Hamlin
(74) *Attorney, Agent, or Firm*—Oliff & Berridge, PLC

(57) ABSTRACT

An electro-rheological fluid made from an oil medium and fine particulates by mixing, is highly reliable and in which dielectric breakdown, such as generation of electrical discharge, is very low even when a high voltage is applied. A method of manufacturing the electro-rheological fluid and a method of storing the fluid are also provided. The electro-rheolological fluid includes fine particulates dispersed in an oil medium having an electric insulation property, and has a dielectric breakdown strength of 4 kV/mm or more. When the electro-rheological fluid is placed under a reduced pressure of 10 Pa, foaming does not occur. Alternatively, the electro-reheoleological fluid can contain 20% by volume or more of a gas contained in the oil medium that has a dielectric breakdown strength of 4 kV/mm or more.

12 Claims, No Drawings

ELECTRO-RHEOLOGICAL FLUID HAVING HIGH DIELECTRIC BREAKDOWN STENGTH AND METHODS OF MAKING AND STORING THE ELECTRO-RHEOLOGICAL FLUID

BACKGROUND OF THE INVENTION

1. Field of the Invention

The present invention relates to an electro-rheological fluid, and more particularly to an electro-rheological fluid having high resistance to dielectric breakdown (hereinafter, "dielectric breakdown strength"), and methods of manufacturing and storing the same.

2. Description of the Related Art

An electro-rheological fluid is a fluid that can significantly and reversibly change its rheological characteristics with electrical control. The phenomenon of dramatic change of the apparent viscosity of a fluid through the application of an electric field has been known as the Winslow effect for a long time. The application of this effect to components for electrically controlling devices or parts, such as clutches, valves, engine mounts, actuators, and robot arms has been discussed.

As a result, many proposals have been made on particles or liquid mediums used as a dispersoid for the purpose of obtaining a fluid having a high electro-rheological effect and excellent reproducibility. Conventionally, when a high voltage of 2.5 to 3.5 kV/mm or more is applied to an electro-rheological fluid (hereinafter occasionally referred to as "ERF") under a flow, it is found that electrical discharge generates frequently such that the fluid cannot be actually used.

It has been discovered that an oil type medium, such as dimethylsilicone or fluorosilicone, and anhydrous particulates such as carbonaceous particulates which form this ERF have dielectric breakdown strengths of 6 kV/mm or more respectively. Accordingly, even if both the oil type medium and the conductive particles used are materials having high dielectric breakdown strengths, it is found that the dielectric breakdown strength of the obtained ERF does not reach a desired level.

When such an electro-rheological fluid is applied to dampers or clutches, a practical vibration controlling effect or the like cannot be obtained due to electrical discharge, and thereby reliability lowers.

An object of the present invention is to provide an electro-rheological fluid made of an oil type medium and fine particulates by mixing, which is highly reliable and in which dielectric breakdown such as generation of electrical discharge hardly occurs at all even if high voltage is applied to the ERF. Further, a second object of the present invention is to provide a method of manufacturing an electro-rheological fluid by which such an electro-rheological fluid is obtained through a simple process and a method of storing an electro-rheological fluid which can prevent reduction in performance of the fluid at the time of conveyance and storage.

As a result of assiduous studies, the inventors have found that, in a state in which air or air forming gas (nitrogen, oxygen, argon, or the like) is included in an ERF made of an oil type medium and fine particulates by mixing, electrical discharge generates when a high voltage of 3.5 kv/mm or more is applied under a flow, and that the above-described objects are achieved by preventing the generation of electrical discharge. The present invention has been thereby completed.

SUMMARY OF THE INVENTION

An electro-rheological fluid of the present invention is an electro-rheological fluid comprising fine particulates dispersed in an oil type medium having an electric insulation property and has a dielectric breakdown strength of 4 kV/mm or more. As a preferable aspect, foaming does not take place when the electro-rheological fluid is placed under a reduced pressure of 10 Pa, or alternatively, 20% or more by volume of a gas contained in the oil type medium is a gas having a dielectric breakdown strength of 4 kV/mm or more.

Further, a method of manufacturing an electro-rheological fluid of the present invention includes a step of stirring and mixing particles and an oil type medium under a reduced pressure of 10 kPa (about 0.1 atmospheric pressure) or less, preferably 1000 Pa or less, or alternatively, a step of degassing a mixture, which was obtained by stirring and mixing particles and an oil type medium and which is disposed under a reduced pressure of 10 kPa or less, preferably 1000 Pa or less. It is preferable that this degassing step takes place while heating the mixture at 40° C. to 80° C. and/or stirring the mixture with rotational stirring blades or with irradiation of supersonic waves, or the like.

In a method of storing an electro-rheological fluid of the present invention, a container for storing the electro-rheological fluid, in which fine particulates are dispersed in an oil type medium having an electric insulation property, is filled with a gas having a strong electron attracting capability and a high dielectric breakdown strength and is thereafter sealed. It is preferable that the gas having a strong electron attracting capability and a high dielectric breakdown strength is of one or more selected from among $SF_6$, $CCl_2F_2$, $C_3F_8$, $C_2F_6$, $C_5F_8$, $CF_3CN$, $C_2F_5CN$, $Cl_2$, $SOF_2$, $C_2ClF_5$, and $ClO_3F$ (each having a halogen atom, a CN group, or a SO group in its molecule).

DETAILED DESCRIPTION OF THE INVENTION

Fine particulates which are preferably used for an electro-rheological fluid of the present invention can be any particle that is known as a particle for an electro-rheological fluid. These include organic semiconductor particulates, carbonaceous particulates, polyurethane particulates, surface-insulated membrane coated particulates, organic and inorganic complex particulates, ceramic particulates, hydrous particulates, or the like.

A preferable example of the fine particulates which can be used in the present invention is a carbonaceous particle. As the carbonaceous particulates, those having a carbon content of 80 to 97% by weight are preferable, and 85 to 95% by weight are more preferable. Further, a C/H ratio (carbon/hydrogen atom ratio) of the carbonaceous particles is preferably from 1.2 to 5, and is more preferably from 2 to 4.

It has been known for a long time that the electrical resistance of the dispersed phase of an electro-rheological fluid is, in general, in a semiconductor domain (W. M. Winslow: J. Appl. Physics vol. 20, page 1137 (1949)), however, carbonaceous particles having a carbon content of less than 80% by weight and a C/H ratio of less than 1.2 are insulating materials, and thus a fluid having an electro-rheological effect can barely be obtained therefrom. On the other hand, those having a carbon content of more than 97% by weight and a C/H ratio of more than 5 are similar to conductive materials and show an excessively large electric current even when voltage is applied, and thus a fluid having an electro-rheological effect cannot be obtained.

Examples of methods of manufacturing these carbonaceous particles include a method of heat-treating pulverizing, and classifying mesophase that was produced by heat-treating pitch or the like, a method of carbonizing a thermosetting resin by heat-treating, and a method of carbonizing aromatic sulfonic acids or a condensation product of a salt thereof, formed in a fine spherical body, by heat-treating in an inert gas atmosphere such as nitrogen, argon, or the like.

The average particle size of the particles can be measured with a particle size analyzer (e.g., MICROTRAC SPA/MK-II TYPE manufactured by Nikldso Co., Ltd.) as mentioned in the Examples. The average particle size of the particles for an electro-rheological fluid obtained after the carbonizing treatment is preferably about 0.1 to 20 $\mu$m, and more preferably 0.5 to 15 $\mu$m. If the average particle size is less than 0.1 $\mu$m, the initial viscosity of the obtained electro-rheological fluid becomes high. If the average particle size is more than 20 $\mu$m, the dispersion stability of the particles deteriorates. Neither is preferable.

The electro-rheological fluid of the present invention is obtained by dispersing the particles for the electro-rheological fluid obtained as described above in an oil type medium having an electric insulation property. The particles for an electro-rheological fluid, which are dispersed phase, are contained in the electro-rheological fluid at a level of 1 to 60% by weight, preferably 20 to 50% by weight, and the oil type medium, which is the dispersion medium, is contained at a level of 99 to 40% by weight, preferably 80 to 50% by weight. If the dispersed phase content is less than 1% by weight, the electro-rheological effect is small, and if the dispersed phase content is more than 60% by weight, the initial viscosity when voltage is not applied becomes high, and thus neither is preferable.

The oil type medium, which is a dispersion medium having an electric insulation property, preferably has a volume resistivity at 80° C. of $10^{11}\Omega$.cm or more. A value of $10^{13}\Omega$.cm or more is particularly preferable. For example, hydrocarbon oil, ester type oil, aromatic type oil, and silicone oil can be presented. Concrete examples include an ester of an aliphatic monocarboxylic acid such as neocapric acid; an ester of an aromatic monocarboxylic acid such as benzoic acid; an ester of an aliphatic dicarboxylic acid such as adipic acid, glutaric acid, sebacic acid, or azelaic acid; an ester of an aromatic dicarboxylic acid such as phthalic acid, isophthalic acid, or tetrahydrophthalic acid; dimethyl polysiloxane, methyl phenyl polysiloxane, methyl trifluoro propyl polysiloxane, and a mixture or copolymer of these. These can be used alone or in combinations of two or more.

The oil type medium having an electric insulation property preferably has a viscosity at 25° C. of 0.65 to 500 centistokes, more preferably 2 to 200 centistokes. A value of 5 to 50 centistokes is particularly preferable. By using a dispersion medium having a preferable viscosity, the particles, which are dispersoid, can be dispersed efficiently and stably. If the viscosity of the oil type medium is more than 500 centistokes, the initial viscosity of the electro-rheological fluid becomes high, resulting in a small viscosity change brought about by the electro-rheological effect. Further, if the viscosity is less than 0.65 centistokes, evaporation easily occurs, and the stability of the dispersion medium deteriorates.

The electro-rheological fluid of the present invention needs to have a dielectric breakdown strength of 4 kV/mm or more. However, in order to achieve this, it is important to prevent the aforementioned air or gas (nitrogen, oxygen, argon, or the like) which forms air from being included in the fluid. In order to verify this characteristic, first, the electro-rheological fluid is placed under a reduced pressure of 10 Pa. If foaming does not take place, it is preferable. In this way, a gas component is hardly included in the electro-rheological fluid in a flowing state. If foaming does not take place in this state, it is considered that inclusion of the gas does not affect reduction in dielectric breakdown strength.

On the other hand, inclusion of a gas becomes a problem only when a gas that causes electrical discharge when high voltage is applied to the electro-rheological fluid in a foaming state is included, and it is not a problem when a gas that does not have such a characteristic is included. More specifically, if 20% or more by volume or more of the gas contained within the oil type medium of the electro-rheological fluid of the present invention has a relatively large molecular weight and a high dielectric breakdown strength, in other words, if the gas has a strong electron attracting capability and a dielectric breakdown strength of 4 kV/mm or more, reduction in the dielectric breakdown strength of the ERF does not occur. The dielectric breakdown strength of gas can be measured in accordance with an ordinary method.

Concrete examples of the gas that does not reduce these dielectric strengths, i.e., the gas that has a dielectric breakdown strength of 4 kV/mm or more, include $SF_6$ (hereinafter, the dielectric breakdown strength will be referred in a parenthesis: 6.6 kV/mm), $CCl_2F_2$ (6.4 kV/mm), $C_3F_8$ (5.8 kV/mm), $C_2F_6$ (4.8 kV/mm), $C_5F_8$ (14.5 kV/mm), $CF_3CN$ (9.2 kV/mm), $C_2F_5CN$ (11.9 kV/mm), $Cl_2$ (4.1 kV/mm), $SOF_2$ (6.6 kV/mm), $C_2ClF_5$ (6.0 kV/mm), and $ClO_3F$ (7.2 kV/mm). Each has a halogen atom, a CN group, or an SO group in its molecule.

Next, methods of manufacturing the electro-rheological fluid of the present invention will be explained. Examples of the methods of manufacturing the electro-rheological fluid include a method of manufacturing the ERF by mixing particles and an oil type medium under reduced pressure and a post-treatment that efficiently deaerates air or air-forming gas, under reduced pressure, from an ERF that has been mixed under normal pressure. The dielectric strength of the ERF is remarkably improved in accordance with either of these two methods.

Namely, the former method includes a process for stirring and mixing the particles and the oil type medium under reduced pressure. The reduced pressure is 10 kPa (about 0.1 atmospheric pressure) or less, preferably 1000 Pa or less, and more preferably 100 Pa or less.

On the other hand, when the electro-rheological fluid that has been manufactured at a normal pressure is subjected to reduced pressure and degassing, a mixture obtained by stirring and mixing the particles and the oil type medium is placed under reduced pressure and subjected to degassing for a predetermined time. At this time, it is preferable that degassing is effected while the mixture is heated at 40° C. to 80° C. and/or stirred. This condition of reduced pressure is the same as the one at the time of manufacturing.

Moreover, a condition of heating is preferably within a range of 40 to 80° C. If the temperature is less than 40° C., viscosity of the fluid is high and degassing is not carried out sufficiently. If the temperature is more than 80° C., there is worry that stability of the electro-rheological fluid deteriorates.

The stirring in the process of degassing can be effected in accordance with an ordinary method. For example, the stirring may be effected with rotational stirring blades or with irradiation of ultrasonic a waves. In a case of rotational stirring, the rotational speed of the blades is preferably about 10 to 200 rpm. In a case of ultrasonic irradiation, the output is preferably 30 W or more.

On the other hand, when the above-described (mixed under reduced pressure or degassing) ERF having a high dielectric breakdown strength is used/stored, there is worry that gas may be included again and the dielectric strength may be reduced when, for example, the ERF is vibrated within a container during conveyance. Thus, a gas having a strong electron attracting capability and a high dielectric breakdown strength rather than air or air-forming gas is included together with the ERF in a device or a storage container. Accordingly, even if the device is operated or the entire storage container is vibrated, reduction in the dielectric strength of the ERF due to inclusion of gas into the fluid can be prevented.

It is considered that the gas having a high dielectric breakdown strength has, in general, a large electronegativity (more specifically, a dielectric breakdown strength of 4.0 kV/mm or more) and a large molecular weight. Examples of the gas include $SF_6$, $CCl_2F_2$, $C_3F_8$, $C_2F_6$, $C_5F_8$, $CF_3CN$, $C_2F_5CN$, $Cl_2$, $SOF_2$, $C_2ClF_5$, and $ClO_3F$, each having a halogen atom, a CN group, or a SO group in its molecules.

A high dielectric strength at the time of manufacturing can be maintained by conveying the ERF in a container filled with such a gas. Further, reduction in the dielectric strength with time can be prevented and high reliability can be maintained for a long time by filling such a gas in a device such as a damper, which is used by being filled with an electro-rheological fluid.

EXAMPLES

Hereinafter the present invention will be explained in more detail with reference to concrete examples. However, the present invention is not limited to these examples.

Property Evaluations (1) Measurement of Particle Size

The particle size of the particles for the electro-rheological fluid was measured with a MICROTRAC SPA/MK-II type manufactured by Nikkiso Co., Ltd.

(2) Measurement of Dielectric Breakdown Strength of ERF

When the field strength was increased from 3.0 kV/mm at an interval of 0.1 kV/mm every 30 seconds at room temperature (about 25° C.) and at a shearing rate of 1000/second with an RDS-II type rheometer manufactured by RHEOMETRICS Co., Ltd. and a 610 type high voltage power supply manufactured by TREK Co., Ltd., the field strength at which electrical discharge was generated was referred to as the dielectric breakdown strength (dielectric strength) of ERF.

In this case, since high voltage was applied for 10 minutes until the field strength reaches, for example, 5.0 kV/mm, the dielectric breakdown strength of the ERF obtained in this method is estimated to be lower than the actual characteristic value of the material (in other words, the actual dielectric breakdown strength is much higher).

Example 1

Preparation of Carbonaceous Particle Material 1050 g of sulfuric acid was added to 1280 g of naphthalene, and reacted at 160° C. for 2 hours. An unreacted product was discharged outside container under reduced pressure. Then, 857 g of 35% by weight concentration formalin was added and reacted at 105° C. for 5 hours to obtain a methylene bond type condensation product of β-naphthalene sulfonic acid. After neutralization with ammonium water, the condensation product was filtrated to yield a filtrate.

Water was added to the obtained filtrate containing a methylene bond type condensation product of β-naphthalene sulfonic acid so as to prepare a 20% by weight concentration aqueous solution of a methylene bond type product of ammonium salt of β-naphthalene sulfonate.

This aqueous solution was sprayed with a spray drier at an air pressure of 5 kg/cm$^2$ and granulated/dried by introducing drying air. The average particle size (50% volume average size) of the spherical carbonaceous particles of the methylene bond type condensation product of sulfonic acid mainly comprising methyl naphthalene obtained as mentioned above was 7.0 μm.

Preparation of Particles for Electro-Rheological Fluid

Spherical particles were obtained by a preliminary heat treatment of the obtained carbonaceous particles at 400° C. in a nitrogen gas atmosphere. The carbon content, the carbon/hydrogen atom ratio (hereinafter referred to as the C/H ratio), and the average particle size of the particles were 90.8%, 2.0, and 7.0 gm, respectively. The spherical particles for the electro-rheological fluid were obtained by heating (carbonizing treatment) at 540° C. in a nitrogen gas atmosphere for 4 hours, atomizing, and classifying. The carbon content, the C/H ratio, and the average particle size of the particles were 93.6%, 2.4, and 7 μm, respectively.

Preparation of Electro-Rheological Fluid

45% by weight of the spherical carbonaceous particles obtained in Example 1 was dispersed well in 55% by weight of a copolymer of dimethyl polysiloxane and methyl trifluoro propyl polysiloxane (mol ratio of 60 to 40), which is a dispersing medium having a viscosity of 10 centistokes at 25° C., and was stirred under reduced pressure of 1000 Pa so as to obtain an electro-rheological fluid.

The dielectric strength of the electro-rheological fluid obtained was measured in accordance with the above method, and as a result, the dielectric strength was found to be 4.2 kV/mm.

Example 2

Under the same conditions as Example 1 except that the reduced pressure was 100 Pa, an electro-rheological fluid was obtained. The dielectric strength of the electro-rheological fluid obtained was measured in accordance with the same method as Example 1, and as a result, it was found that electrical discharge did not occur at least at 4.5 kV/mm and that the dielectric strength was 4.5 kV/mm or more.

Example 3

Under the same conditions as Example 2 except that the reduced pressure was 10 Pa, an electro-rheological fluid was obtained. The dielectric strength of the electro-rheological fluid obtained was measured in accordance with the same method as Example 1, and as a result, it was found that electrical discharge did not occur at least at 5.1 kV/mm and that the dielectric strength was 5.1 kV/mm or more.

Comparative Example 1

Under the same conditions as Example 1 except that pressure was not reduced and stirring was effected with a ball mill under normal pressure, an electro-rheological fluid was obtained. The dielectric strength of the electro-rheological fluid obtained was measured in accordance with the same method as in Example 1, and as a result, the dielectric strength was found to be 3.2 kV/mm.

Comparative Example 2

Under the same conditions as Example 1 except that pressure was not reduced and stirring was effected with a mortar grinder under normal pressure, an electro-rheological fluid was obtained. The dielectric strength of the electro-rheological fluid obtained was measured in accordance with the same method as Example 1, and as a result, the dielectric strength was found to be 3.6 kV/mm.

Example 4

The electro-rheological fluid obtained in Comparative Example 2 was held under a reduced pressure of 10 Pa for 30 minutes in a sealable container and subjected to a degassing treatment. The dielectric strength of the treated electro-rheological fluid was measured in accordance with the same method as Example 1, and as a result, the dielectric strength was found to be 4.2 kV/mm.

Example 5

The electro-rheological fluid obtained in Comparative Example 2 was held under a reduced pressure of 10 Pa for 30 minutes in a vacuum chamber while being heated at 60° C. and subjected to a degassing treatment. The dielectric strength of the electro-rheological fluid treated was measured in accordance with the same method as Example 1, and as a result, it was found that electrical discharge did not occur at least at 5.0 kV/mm and that the dielectric strength was 5.0 kV/mm or more.

Example 6

The electro-rheological fluid obtained in Comparative Example 2 was stirred by rotational blades under a reduced pressure of 10 Pa for 60 minutes in a vacuum chamber and subjected to a degassing treatment. The rotational speed of the stirring blades was 40 rpm. The dielectric strength of the treated electro-rheological fluid was measured in accordance with the same method as Example 1, and as a result, it was found that electrical discharge did not occur at least at 5.0 kV/mm and that the dielectric strength was 5.0 kV/mm or more.

Example 7

The electro-rheological fluid obtained in Comparative Example 2 was stirred by irradiating ultrasonic waves under a reduced pressure of 10 Pa for 15 minutes in a vacuum chamber and subjected to a degassing treatment. The conditions of irradiation of the ultrasonic waves was 40 Hz and 100 W. The dielectric strength of the treated electro-rheological fluid was measured in accordance with the same method as Example 1, and as a result, it was found that electrical discharge did not occur at least at 5.0 kV/mm and that the dielectric strength was 5.0 kV/mm or more.

Comparative Example 3

Under the same conditions as Comparative Example 2 except that dimethyl polysiloxane having a viscosity of 10 centistokes at 25° C. (TSF451-10 manufactured by Toshiba Silicone Co., Ltd.) was used as the oil type medium, an electro-rheological fluid was obtained. The dielectric strength of the electro-rheological fluid obtained was measured in accordance with the same method as Example 1, and as a result, the dielectric strength was found to be 3.9 kV/mm.

Example 8

The electro-rheological fluid obtained in Comparative Example 3 was subjected to a degassing treatment in a vacuum chamber, while being heated at 60° C., under a reduced pressure of 10 Pa for 30 minutes. The dielectric strength of the electro-rheological fluid treated was measured in accordance with the same method as Example 1, and as a result, it was found that electrical discharge did not occur at least at 5.0 kV/mm and that the dielectric strength was 5.0 kV/mm or more.

Comparative Example 4

Under the same conditions as Example 1 except that an operating condition of the spray drier was changed in the processes. The particles were classified by a classifier such that particles for an electro-rheological fluid were obtained. The carbon content, the C/H ratio, and the average particle size of the particles were 93.5%, 2.2, and 3 $\mu$m, respectively.

An electro-rheological fluid was obtained in the same way as Comparative Example 2, using these particles for an electro-rheological fluid. The dielectric strength of the electro-rheological fluid obtained was measured in accordance with the same method as Example 1, and as a result, the dielectric strength was found to be 3.8 kV/mm.

Example 9

The electro-rheological fluid obtained in Comparative Example 4 was subjected to a degassing treatment in a vacuum chamber, while being heated at 60° C., under a reduced pressure of 10 Pa for 30 minutes. The dielectric strength of the treated electro-rheological fluid was measured in accordance with the same method as Example 1, and as a result, it was found that electrical discharge did not occur at least at 5.0 kV/mm and that the dielectric strength was 5.0 kV/mm or more.

Comparative Example 5

After a mesophase-growing process by a heat treatment of coal tar pitch at 450° C. in a nitrogen gas atmosphere, the coal tar pitch was repeatedly extracted and separated by filtration in tar oil to eliminate the pitch component. After another heat treatment at 350° C. in a nitrogen reflux, it was pulverized to obtain amorphous particles. The carbon content and the C/H ratio of the particles were 90.8% and 2.0, respectively. Further, particles for an electro-rheological fluid were obtained by conducting a heat treatment at a temperature of 500° C. for 4 hours in a rotary kiln in a nitrogen atmosphere. The carbon content and the C/H ratio of the particles were 93.6% and 2.4, respectively.

Using the carbonaceous particles obtained, an electro-rheological fluid was obtained in the same way as Comparative Example 2. The dielectric strength of the electro-rheological fluid obtained was measured in accordance with the same method as Example 1, and as a result, the dielectric strength was found to be 3.9 kV/mm.

Example 10

The electro-rheological fluid obtained in Comparative Example 5 was subjected to a degassing treatment in a sealable container, while being heated at 60° C., under a reduced pressure of 10 Pa for 30 minutes. The dielectric strength of the electro-rheological fluid treated was measured in accordance with the same method as Example 1, and as a result, it was found that electrical discharge did not occur at least at 4.5 kV/mm and that the dielectric strength was 4.5 kV/mm or more.

Example 11

Storage of Electro-Rheological Fluid

The electro-rheological fluid obtained in Example 1 was placed in a sealable storage container. The air within the container was replaced with $SF_6$ gas, and thereafter the container was sealed. This storage container was shaken hard for 10 minutes. The electro-rheological fluid was removed from the container after shaking. The dielectric strength of the electro-rheological fluid processed was measured in accordance with the same method as Example 1, and as a result, it was found that electrical discharge did not occur at least at 5.1 kV/mm and that the dielectric strength was 5.1 kV/mm or more.

Comparative Example 6

Storage of Electro-Rheological Fluid

A storage container was filled with the electro-rheological fluid obtained in Example 1 together with air and then the container was sealed. This storage container was shaken hard for 10 minutes. The electro-rheological fluid was removed from the container after shaking. The dielectric strength of the electro-rheological fluid processed was measured in accordance with the same method as Example 1, and as a result, the dielectric strength was found to be 3.7 kV/mm.

Post Treatment

The electro-rheological fluid stored in Comparative Example 6 was subjected to a degassing treatment under a reduced pressure of 10 Pa for 30 minutes in a vacuum chamber. The dielectric strength of the electro-rheological fluid treated was measured in accordance with the same method as Example 1, and as a result, the dielectric strength was found to be 4.8 kV/mm. Even if the dielectric strength of the electro-rheological fluid was reduced by including air during storage, it was seen that the dielectric strength was recovered by effecting the post treatment, i.e., the process for degassing.

Comparative Example 7

Storage of Electro-Rheological Fluid

The electro-rheological fluid obtained in Example 1 was placed in a sealable storage container. The air within the container was replaced with Ar gas, and thereafter the container was sealed. This storage container was shaken hard for 10 minutes. The electro-rheological fluid was removed from the container after shaking. The dielectric strength of the electro-rheological fluid treated was measured in accordance with the same method as Example 1, and as a result, the dielectric strength was found to be 3.9 kV/mm. Accordingly, if the container was filled with inert gas such as Ar gas or the like, it was found that the reduction in the dielectric strength of the electro-rheological fluid during storage cannot be prevented.

Post Treatment

The electro-rheological fluid stored in Comparative Example 7 was subjected to a degassing treatment under a reduced pressure of 10 Pa for 30 minutes in a vacuum chamber. The dielectric strength of the treated electro-rheological fluid was measured in accordance with the same method as Example 1, and as a result, the dielectric strength was found to be 4.5 kV/mm or more. Even if the dielectric strength of the electro-rheological fluid was reduced by including inert gas such as Ar gas or the like during storage, it was seen that the dielectric strength was recovered by effecting the post treatment, i.e., the process of degassing.

Example 12

Electro-Rheological Fluid Applied Damper

When the electro-rheological fluid obtained in Example 1 was used with a damper, the damper was filled with $SF_6$ gas as a buffer gas. This damper has excellent dielectric strength in that electrical discharge does not occur even if the field strength was applied at 6.0 kV/mm. Further, the same evaluations were made after this damper was repeatedly used for 56 hours, and it was found that the dielectric strength was not reduced and that the damper was highly reliable.

A superior effect is achieved in that the electro-rheological fluid of the present invention is highly reliable and dielectric breakdown such as generation of electrical discharge or the like hardly occurs at all even if a high voltage is applied. Moreover, the electro-rheological fluid having the above-described excellent characteristics can be obtained through a simple process in accordance with the method of manufacturing the electro-rheological fluid, and reduction in the dielectric strength of the electro-rheological fluid at the time of conveyance and storage can be effectively prevented in accordance with the method of storing the electro-rheological fluid of the present invention.

What is claimed is:

1. A method of manufacturing an electro-rheological fluid, comprising stirring and mixing fine particulates and an oil medium under a reduced pressure of 1 kPa or less.

2. The method of claim 1, wherein the reduced pressure is 0.1 kPa or less.

3. The method of claim 1, wherein the oil medium comprises 20% or more by volume of at least one gas selected from the group consisting of $SF_6$, $CCl_2F_2$, $C_3F_8$, $C_2F_6$, $C_5F_8$, $CF_3CN$, $C_2F_5CN$, $Cl_2$, $SOF_2$, $C_2ClF_5$, and $ClO_3F$.

4. The method of claim 1, wherein the electro-rheological fluid has a dielectric breakdown strength of at least 4 kV/mm.

5. The method of claim 1, wherein the reduced pressure is 0.01 kPa.

6. A method of manufacturing an electro-rheological fluid, comprising degassing a mixture obtained by stirring and mixing fine particulates and an oil medium under a reduced pressure of 11 kPa or less.

7. The method of claim 6, wherein the degassing comprises heating the mixture at a temperature of 40 to 80° C. while the mixture is being degassed.

8. The method of claim 6, wherein the degassing comprises stirring the mixture while the mixture is being degassed.

9. The method of claim 6, wherein the degassing comprises irradiating the mixture with ultrasonic waves while the mixture is being degassed.

10. The method of claim 6, wherein the reduced pressure is 0.1 kPa or less.

11. The method of claim 6, wherein the electro-rheological fluid has a dielectric breakdown strength of at least 4 kV/mm.

12. The method of claim 6, wherein the reduced pressure is 0.01 kPa.

* * * * *